US005617685A

United States Patent [19]

Meier et al.

[11] Patent Number: 5,617,685

[45] Date of Patent: Apr. 8, 1997

[54] METHOD AND APPARATUS FOR INCREASING THE SHEAR STRENGTH OF A CONSTRUCTION STRUCTURE

[75] Inventors: Urs Meier, Schwerzenbach; Martin Deuring, Zurich; Heinz Meier, Winterthur, all of Switzerland

[73] Assignee: Eidgenoessische Materialpruefungs-Und Forschungsanstalt Empa, Switzerland

[21] Appl. No.: 157,104

[22] PCT Filed: Mar. 26, 1993

[86] PCT No.: PCT/CH93/00085

§ 371 Date: Oct. 24, 1994

§ 102(e) Date: Oct. 24, 1994

[87] PCT Pub. No.: WO93/20296

PCT Pub. Date: Oct. 14, 1993

[30] Foreign Application Priority Data

Apr. 6, 1992 [CH] Switzerland ..... 1113/92

[51] Int. Cl.[6] ..... E04C 3/26; E04C 3/293

[52] U.S. Cl. ..... 52/223.8; 52/223.6; 52/223.13; 52/223.14; 52/724.1; 52/724.5; 52/730.2; 52/731.7; 52/737.2; 52/737.4; 52/738.1; 52/745.19

[58] Field of Search ..... 52/223.13, 223.14, 52/223.8, 223.1, 223.6, 721.4, 724.1, 724.2, 724.5, 730.2, 731.1, 731.7, 737.1, 737.2, 737.3, 737.4, 738.1, 740.1, 745.19

[56] References Cited

U.S. PATENT DOCUMENTS

| | | | |
|---|---|---|---|
| 897,539 | 9/1908 | Keighley | 52/731.1 X |
| 2,238,514 | 4/1941 | Weeks et al. | 52/724.5 X |
| 2,601,910 | 7/1952 | Nichols | 52/223.8 X |
| 2,618,147 | 11/1952 | Freyssinet | 52/223.13 |
| 2,675,695 | 4/1954 | Coff | 52/223.8 |
| 2,869,214 | 1/1959 | Van Buren | 52/223.13 X |
| 3,368,016 | 2/1968 | Birguer | 52/223.8 X |
| 3,422,501 | 1/1969 | Yoshimura | 52/223.13 X |
| 3,422,586 | 1/1969 | Parma | 52/223.13 |
| 3,457,687 | 7/1969 | Jacobus | 52/223.13 |
| 4,105,739 | 8/1978 | Dave | 52/724.5 X |
| 4,934,118 | 6/1990 | Miebeler | 52/223.13 |
| 4,965,973 | 10/1990 | Engebretsen | 52/223.8 |
| 5,479,748 | 1/1996 | Siller | 52/223.8 X |

FOREIGN PATENT DOCUMENTS

| | | | |
|---|---|---|---|
| 117965 | 9/1984 | European Pat. Off. . | |
| 1443022 | 5/1966 | France . | |
| 2516573 | 5/1983 | France | 52/223.13 |
| 2726413 | 12/1978 | Germany | 52/223.8 |
| 2917551 | 11/1979 | Germany | 52/738.1 |
| 432527 | 12/1948 | Italy | 52/731.1 |
| 2-161042 | 6/1990 | Japan | 52/745.19 |
| 4444 | 3/1896 | Norway | 52/724.1 |
| 696127 | 11/1979 | U.S.S.R. | 52/724.1 |
| 730943 | 4/1980 | U.S.S.R. | 52/724.1 |
| 1481359 | 5/1989 | U.S.S.R. | 52/737.1 |
| 696097 | 8/1953 | United Kingdom | 52/223.8 |
| 702885 | 1/1954 | United Kingdom | 52/223.8 |
| 740121 | 11/1955 | United Kingdom | 52/223.8 |
| 1398563 | 6/1975 | United Kingdom . | |
| 1431191 | 4/1976 | United Kingdom | 52/223.8 |

*Primary Examiner*—Carl D. Friedman
*Assistant Examiner*—Laura A. Saladino
*Attorney, Agent, or Firm*—Breiner & Breiner

[57] ABSTRACT

In order to strengthen an elongated or a two-dimensional bearing construction structure (1) against shear forces, at least one pre-stressing means (11) is mounted in a slack or pre-stressed manner on or in the structure cross-section (4) to generate a pre-stressing force directed transversely to the length or to the two-dimensional surface of the structure when this structure is shear-loaded.

12 Claims, 6 Drawing Sheets

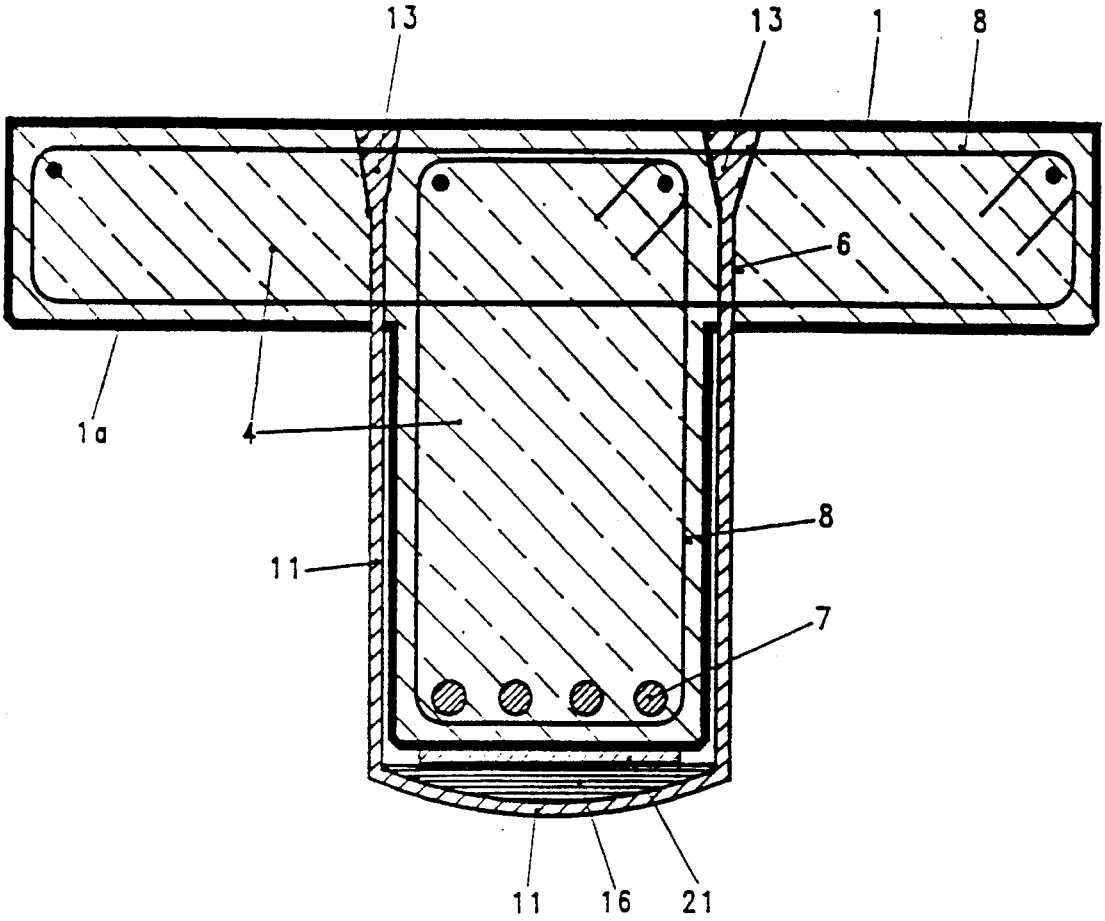
Fig. 3
Fig.3a
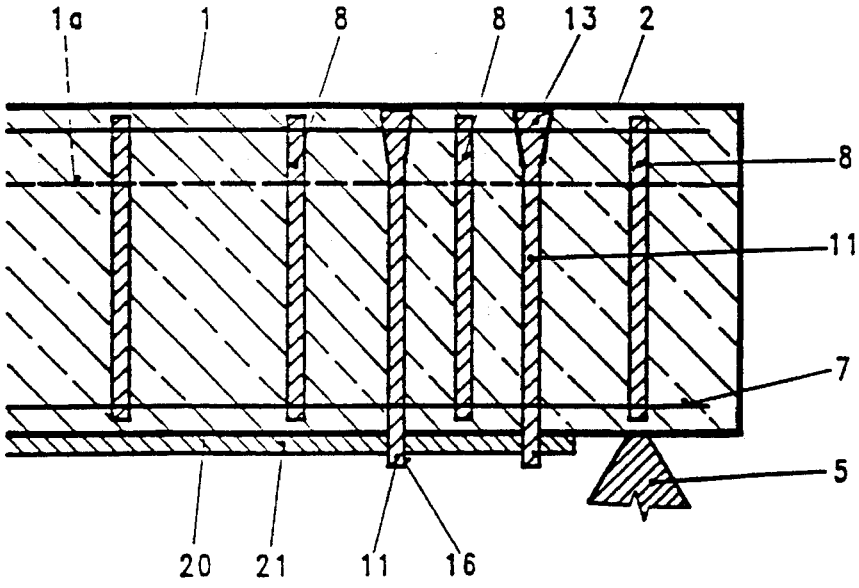

METHOD AND APPARATUS FOR INCREASING THE SHEAR STRENGTH OF A CONSTRUCTION STRUCTURE

The present invention concerns a method for increasing the shear strength of an elongated or a substantially two-dimensional construction structure serving as a support; further a method for increasing the shear strength of a construction structure with an elongated, laminar reinforcement affixed from the outside to the structure to reinforce it; further a method for increasing the shear strength of an elongated or two-dimensional concrete construction structure reinforced on its inside with steel means; applicability of the above methods; apparatus to increase the shear strength of an elongated or substantially two-dimensional bearing construction structure, a bearing construction structure such as of steel reinforced concrete; with apparatus and a procedure to pre-stress a fabric-like hose or tube.

For many years research and development has been applied to retrofitting reinforced concrete by applying additional reinforcement(s). The beginnings of this technique are described in J. Bresson's "Nouvelles Recherches Et Applications Concernant l'Utilisation des Collages Dans Les Structures", Beton Plaque, Annales ITBTP 278 (1971), S érie Béton, Béton Armé Nr. 116. The description goes back to the sixties. Bresson's work especially covered the requirements of compound stresses in the field of anchoring bonded steel laminations.

Accordingly, it has been feasible for two decades to strengthen extant reinforced concrete structures, such as bridges, floor and paving slabs, longitudinal girders and the like, by subsequently bonding steel laminations.

The strengthening of concrete structures by bonding steel laminations using for example epoxy-resin adhesives, now may well be considered a standard technique.

Strengthening may be required for a number of reasons:

increasing the net load;

changing the static systems, for instance, removing post-facto bearing structures such as uprights or struts or reducing their support functions;

strengthening structures in danger of fatigue;

reducing the compliance;

damages in the bearing system or rebuilding extant structure; and defective calculation or implementation of the structure.

Post-facto strengthening by means of bonded steel laminations has been found effective on numerous structures and, illustratively, is described in the following literature: Ladner, M. & Weder, Ch., "Geklebte Bewehrung Im Stahlbetonbau", EMPA Düendorf, Report No. 206 (1981); "Verstaerkung Von Tragkonstruktionen Mit Geklebter Armierung", Schweiz. Bauzeitung, Special print of 92nd year, Issue 19 (1974); "Die Sanierung Der Gizenenbruecke Uuber Die Muota", Schweiz. Ingenieur & Architekt, Special print from Issue 41 (1980).

However, such strengthening procedures incur a number of drawbacks. Steel laminations can be delivered only in short lengths and, therefore, only short laminations can be used. Accordingly, the laminations must butt and potential weak spots must be incurred. The steel laminations are heavy and their handling at the construction site may become quite difficult if the pertinent structures are high or accessible only with difficulty. As regards steel, even when carefully treated against corrosion, there is danger of the laminations under-rusting or that there will be corrosion at the interface of concrete and steel which may lead to detachment and hence to loss of the strengthening.

Accordingly, it was already suggested by U. Meier in "Brueckensanierung Mit Hochleistungs-Faserverbundwerkstoffen", Material+Technik, 15th year, Issue 4 (1987) and further in H. P. Kaiser's dissertation DISS. ETH. No. 8918, ETH ZURICH (1989) to replace the steel laminations by carbon-fiber reinforced epoxy-resin laminations. Laminations made of such material evince low bulk density, high strength, excellent fatigue properties and outstanding corrosion resistance. Accordingly, it is possible to use thin, lightweight carbon-fiber reinforced plastic laminations in lieu of heavy steel ones. The plastic ones, furthermore, may be moved in a nearly endless, rolled-up manner to the construction site. Practical tests have shown that carbon-fiber laminations 0.5 mm thick evince a tensile strength corresponding to the yield point of a 3 mm thick FE360 steel lamination.

The present invention essentially starts from the ETH dissertation and in part represents a further development of the technical solution described therein for strengthening concrete structures. The contents of the ETH dissertation No. 8918 by H. P. Kaiser, Zurich ETH 1989 therefore is an integral part of the present description and is further being omitted.

The results of this ETH dissertation showed that the bending of concrete structures reinforced with carbon-fiber strengthened epoxy resins can be calculated similar to the way it is done for conventional steel reinforced concrete. However, special attention must be paid to the shear crack-formation in the concrete. Shearing cracks lead to offsets at the strengthened surface and as a rule this entails peeling, i.e., detachment of the reinforcing laminations. Accordingly, formation of shear cracks is a significant criterion both as regards the bearing capacity of the unstrengthened structure and any danger of detachment of the retrofitted strengthening lamina.

Accordingly, it is the object of the present invention to create a method to strengthen a steel reinforced concrete structure or a pre-stressed concrete structure against shearing forces to preclude as much as possible the occurrence of shearing cracks or at least to achieve a spectrum of finer cracks.

Another object of the invention is to so strengthen or protect structures strengthened by strengthening laminations, preferably fiber compound laminations, against shearing forces in such a manner that the occurrence of shearing cracks shall be extensively precluded at the interface between the lamination and the concrete and to prevent as much as possible any mismatch in the crack plane if such cracks do arise.

This object is achieved by the invention through a method defined in the claim.

The invention directs that, in order to strengthen an elongated or two-dimensional bearing structure against shearing, pre-stressing means, which pre-stress substantially the cross-sectional area of the structure, be mounted on the cross-section or in it. Advantageously these pre-stressing means are mounted essentially in the peripheral zone or along at least part of the periphery of the structure's cross-section while pointing against this structure. The pre-stressing means can be mounted in a substantially slack or only slightly tensioned manner against the structure when the latter is only slightly shear-loaded or not at all, as a result of which enhanced pre-stressing becomes effective on or in the cross-section only at higher shear loads. On the other hand, the pre-stressing means already can be mounted in a highly tensioned manner against the structure when it is only slightly loaded or not at all.

Preferably, the above mentioned method of shear strengthening is applied to those zones of the structure where shear forces may arise.

The invention furthermore involves a method to enhance the shear resistance of a construction structure with at least one elongated, lamellar reinforcement of the initially cited kind mounted externally on the structure, the lamellar reinforcement being compressed at least in those zones where shear forces arise by pre-stressing means transverse to the lamination and peripherally enclosing it against the structure. On account of such pre-stressing of the zones of the strengthening lamination, the danger of shearing off the strengthening lamination is substantially reduced in the face of shear forces. In addition, the forces applied by the lamination zones against the structure interface, i.e., against the concrete, so prevent or reduce the possibility of shear cracks that in such an event the crack spectrum will contain finer cracks.

In particular when using the fiber compound laminations proposed in the ETH dissertation No. 8918, for example carbon-fiber laminations, it was found advantageous to prestress these laminations additionally mounted on the concrete structure to improve the structure's function and to prevent the lamination from shearing off on account of concrete shear-break in the tension zone. The high expansibility of the carbon-fiber laminations amounts to a windfall as regards the aforementioned pre-stressing. The large elastic elongation and the Young's modulus made to match the particular conditions favorably affect stress-losses due to shrinkage and creep. However, one aspect raises problems, namely anchoring the carbon-fiber laminations during pre-stressing. The forces must be absorbed at least until full hardening of the epoxy resin adhesive, for example by means of tensioning shackles.

Accordingly, the present invention further proposes a method for enhancing shear strength of an elongated or two-dimensional reinforced concrete structure fitted on the inside with a slack or pre-stressed steel reinforcement. The elongated fiber compound lamination is mounted externally to the structure being rigidly connected in the pre-stressed state to the structure and the lamination is compressed at each end zone against the structure by suitable pre-stressing means externally enclosing this structure. On one hand, these pre-stressing means serve to anchor the lamination ends into the structure and, on the other hand, they ensure, by means of the pre-stressing forces directed against the structure, that shear cracks cannot arise at the lamination ends, thereby substantially reducing the danger of the lamination shearing off.

By mounting the above pre-stressing means, the critical factor no longer is shearing off the strengthening lamination but rather tearing it. However, because of the very high tensile strength of fiber compound laminations, this change represents substantial improvement.

Preferably, the pre-stressing means are lamellar or in the shape of tubes, hose-tubes, belts, bars or cables and are made of highly tear-resistant fabrics, illustratively, consisting of steel-, carbon-, glass- and/or aromatic poly-amide-fibers. However, other fiber-reinforced plastics also are suitable as pre-stressing means, for instance mono-axially, i.e., unidirectionally, stretched rovings or the above cited fiber compound laminations suggested for strengthening. The pre-stressing means applied on one side of the cross-section, or the pre-stressing means externally enclosing the lamination and directed at the structure shall preferably be solidly anchored in the opposite zone of the cross-section of the structure, for instance in the compression zone, whereby pre-stressing is maintained. Preferably, the Young's modulus and the geometry of the pre-stressing means shall be selected in such a manner that drops in stressing on account of structure creep and relaxation of the pre-stressing means shall be minimized.

If the structure comprises several inner shear reinforcements mounted essentially transversely to this structure, then the invention also proposes mounting or applying the pre-stressing means substantially midway between two inner shear reinforcements in or on one structure cross-section. When using fiber compound laminations, it can furthermore be advantageous to mount, at intervals, pre-stressing means in the form of belts, bands, hoses, tubes or cables that are substantially distributed over the entire length of the lamination which they are externally enclosing, the pre-stressing means forcing the lamination against the structure in order to counteract the detachment forces acting on the lamination. In the case of extant inner shear reinforcements, it will be advantageous in this event also to mount the pre-stressing means each essentially midway between two inner shear reinforcements.

The above mentioned methods of the invention are especially applicable to shear-strengthening structures such as bridges, bearing or T beams, and floor or paving slabs. Basically, the methods of the invention are suitable for shear-strengthening any construction structures, such as made of steel reinforced concrete that serve as supports. The structures furthermore can be made also of other materials such as wood, metal, plastic and minerals other than concrete, etc.

Apparatus is described with which to carry out the method of the invention and to enhance shear resistance on an elongated or two-dimensional bearing structure. The apparatus is characterized by at least one stressing component in the form of a lamination, belt, hose, tube, band, bar or cable that is mounted in or on a cross-section of the structure in essentially a slack or pre-stressed manner. Preferably, the stressing component is applied in nearly slack or pre-stressed manner at least along a segment or at least against a portion of the periphery of the cross-section. Preferably, the stressing component consists of a fabric or lattice material consisting of steel-, glass-, carbon- and/or aromatic polyamide-fibers or of another fiber-reinforced plastic such as unidirectionally stretched rovings or of the aforementioned fiber compound laminations suggested for strengthening.

A construction structure of the initially described kind, such as a steel reinforced concrete structure, can be strengthened using apparatus defined in this invention against shear loads.

In particular, a construction structure with at least one externally mounted laminar reinforcement, such as a steel lamination or a fiber compound lamination can be further strengthened against shear using the apparatus of the invention. At least one stressing component is mounted in such a manner that it drives, i.e., compresses, the lamination which it encloses externally transversely to its longitudinal direction against the structure. When using a fiber compound lamination, it shall be mounted itself, preferably pre-stressed, on the structure.

The invention includes yet another method to pre-stress the above pre-stressing means, more particularly a hose or a tube made of a fabric-like material and the passing by at least one end through a borehole comprising a conical part flaring in the direction of pre-stressing, and a viscous adhesive, for example a reactive glue which is present in the conically flaring part. Thereupon, the tube is made to pass in the pre-stressing direction through another borehole or a bush which in turn comprises a conical portion flaring in the pre-stressing direction, and a wedge, i.e., a cone, essentially matching the conical portion which is present inside the tube. The cone tip points in the direction opposite that of pre-stressing. Lastly, pre-stressing is achieved by compressive or tensive means in such a way that the tube is pulled in the direction of pre-stressing through the first borehole and through the second borehole or bush and through the compressive or tensive means which preferably are rigidly affixed to the second borehole or bush. The stress applied to the tube by the compressive or tensive means must be maintained until the above cited viscous adhesive has substantially cured.

The described cone or wedge is roughened at least in parts of its surface and, preferably, comprises at least one circular channel transverse to the pre-stressing direction so that the wedge or cone shall be displaced into the tube when this tube is being pre-stressed by the compressive or tensive means and generates a wedging effect so that the tube will be anchored.

The invention is elucidated below in an illustrative manner and in relation to the attached drawings.

FIG. 1 is a lengthwise perspective of a concrete bearing beam comprising the shear strengthening means of the invention.

FIG. 1*a* is a section of the reinforced and/or stressed concrete beam of FIG. 1 along line I—I of FIG. 1.

FIG. 2 is a longitudinal section of a reinforced-concrete bearing beam strengthened by a fiber compound strengthening lamination.

FIG. 2*a* is a cross-section of the beam of FIG. 2.

FIG. 2*b* is a cutaway of the beam of FIG. 2 showing possible types of rupture caused by shear loads.

FIG. 3 is a cross-section of the reinforced-concrete beam of FIG. 2 fitted with shear-strengthening means of the invention.

FIG. 3*a* shows an end position of the beam of FIG. 2 in the rest zone and in the area of the additional fiber compound lamination, comprising two shear-strengthening means of the invention.

FIGS. 4, 4*a*, 4*b* and 4*c* schematically show in longitudinal section the mounting and pre-stressing of a strengthening lamination to a structure and the shear forces arising thereafter, and further the anchoring of the invention of the pre-stressed lamination into the structure.

Figure 6:
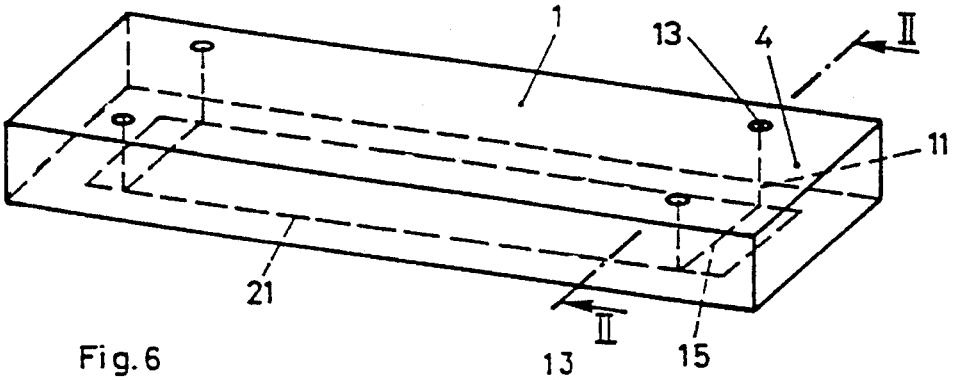
FIG. 6 is a slab structure comprising a strengthening lamination and shear-strengthening of the invention.
Figure 6A:
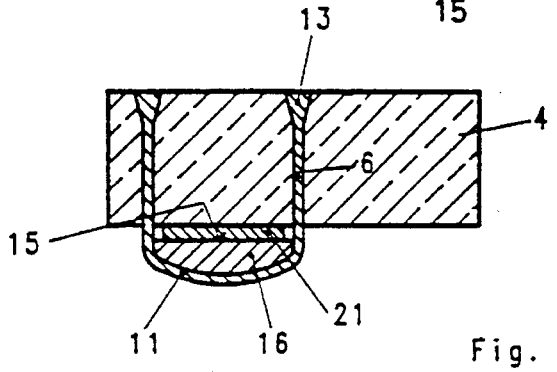

FIG. 6*a* is the slab structure of FIG. 6 shown in cross-section along line II—II.

Figure 7:
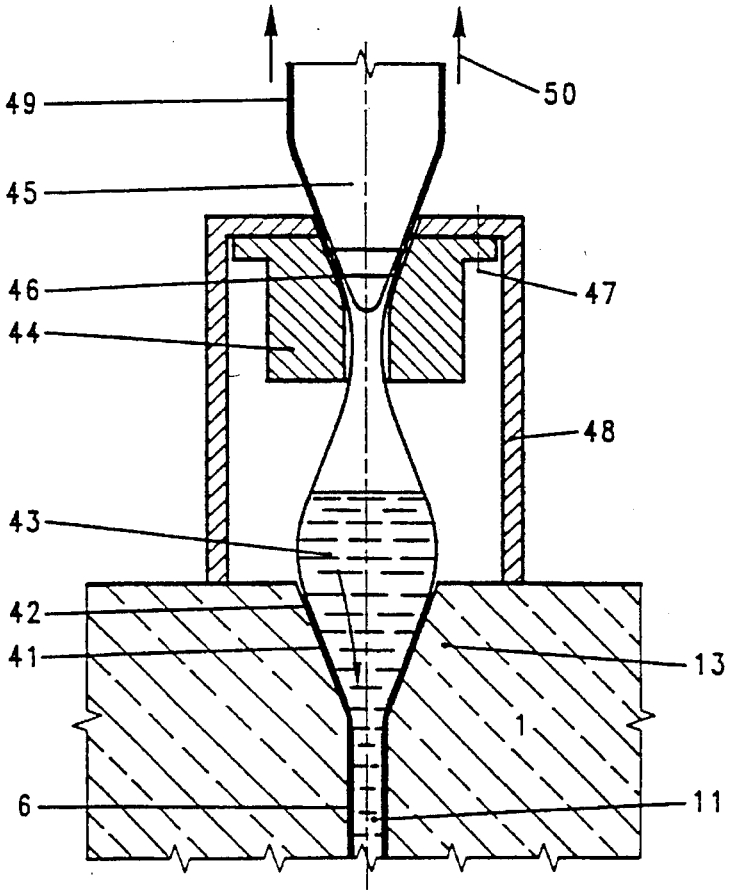

FIG. 7 is a schematic cross-section of apparatus and shows the principle with which to pre-stress a hose or tube-like shear-strengthening means at the structure to be strengthened and to anchor it.

Figure 1:
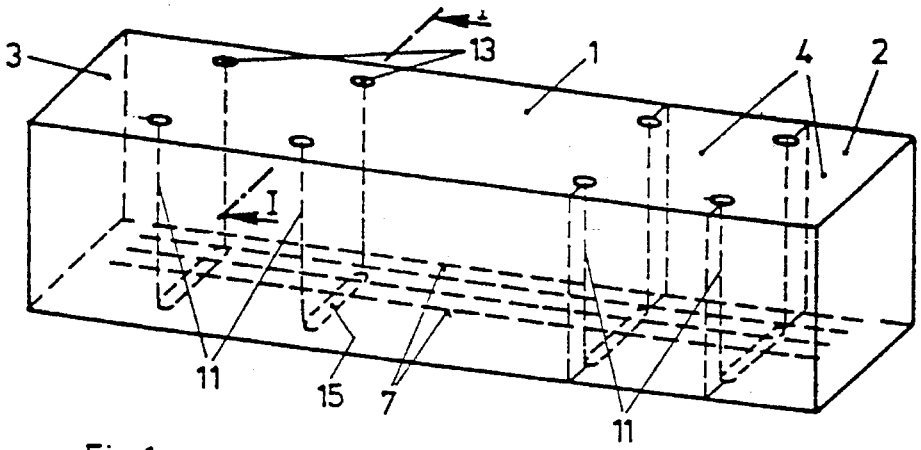

FIG. 1 shows a schematic longitudinal section of a bearing beam 1, such as a concrete or reinforced concrete beam. The shown concrete beam comprises longitudinal steel reinforcement 7 to impart higher bearing capacity to the beam under load.

In order to oppose shearing cracks when the bearing beam 1 is under shear stress, i.e., to strengthen the bearing beam against shearing forces, the invention provides pre-stressing means 11 in each of the beam cross-sections 4. These pre-stressing means either lie slackly against the outer contour 15 in the cross-section 4 or they are mounted compressively against it. Furthermore, they are rigidly anchored into the structure 1 at the sites 13. If they are slack, the pre-stressing means 11 will be tightened only upon shears being applied to the bearing beam 1.

Figure 1A:
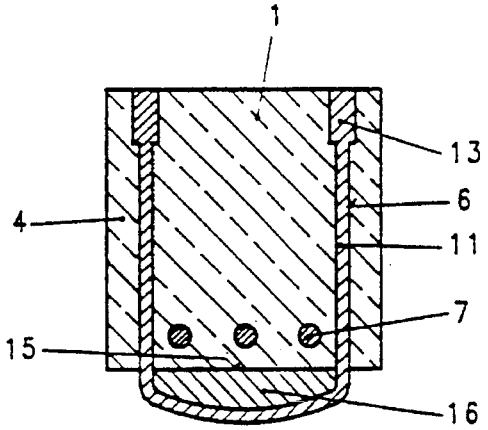

FIG. 1*a* shows a cross-section 4 along line I—I of FIG. 1. The pre-stressing means 11 shown in FIG. 1*a* can be, for example, a highly tear-resistant, well-stressing fabric or mono-axially stretched rovings in the shape of a cable, belt, hose, tube, lamination, bar or band and runs on one hand through the two boreholes 6 in the structure and on the other hand encloses the periphery of the cross-section 4 along the segment 15. The pre-stressing means 11 either rest substantially slackly against the segment or else compressively pre-stressing it. To achieve better distribution of the stressing force on the segment 15 and on the other hand to preclude excessively loading the stressing means 11 on both sides of the segment 15 at the exit of the boreholes 6, advantageously a substrate 16 is provided which, illustratively, can consist of fiber compound materials. Obviously, steel or any other material can also be used, the point being that a stress applied or generated in the stressing means 11, such as a hose, tube, cable etc., shall be maintained. It is important therefore that the pre-stressing means 11 be anchored into the sites 13 in a problem-free manner.

Figure 2A:
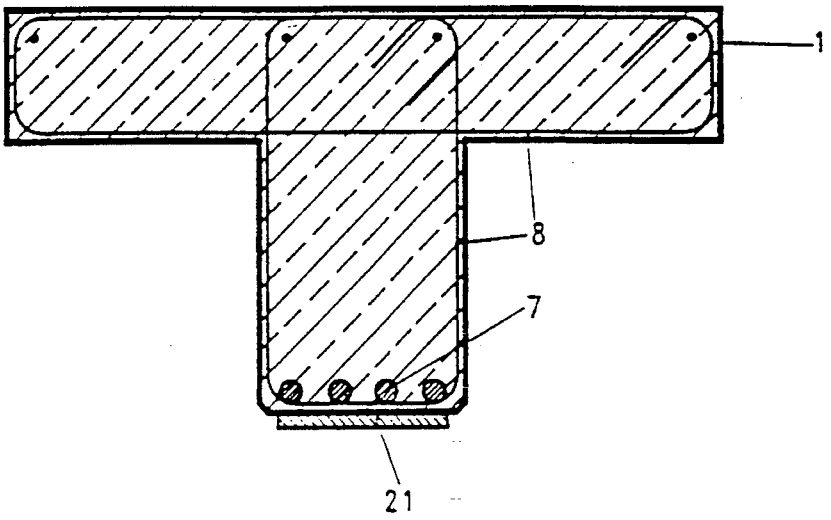
Figure 2:
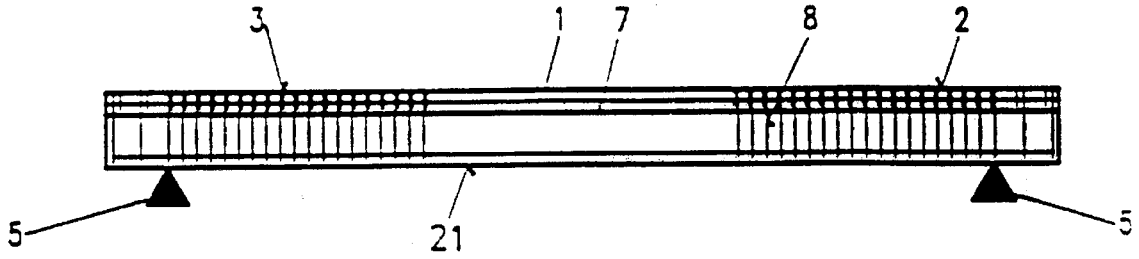

FIG. 2 shows a longitudinal section of a steel reinforced concrete beam 1 resting by its ends in zones 2 and 3 on supports 5. The concrete beam also comprises a steel reinforcement 7 and shear reinforcements 8 transverse thereto. In the sense of the initially discussed ETH dissertation No. 8918, the bearing beam 1 is further fitted with a strengthening lamination 21, illustratively made of a carbon fiber compound material using an epoxy resin matrix. FIG. 2*a* shows the bearing beam 1 of FIG. 2 in cross-section and makes plain that it is a T beam. The strengthening lamination 21 employed can be steel or it can consist of any fiber compound material such as described in the cited ETH dissertation No. 8918. The dissertation is referred to for a description of the advantages in using fiber compound laminations as well as of their shapes, sizes and how to mount them on the structure, and therefore this discussion is omitted herein.

Figure 2B:
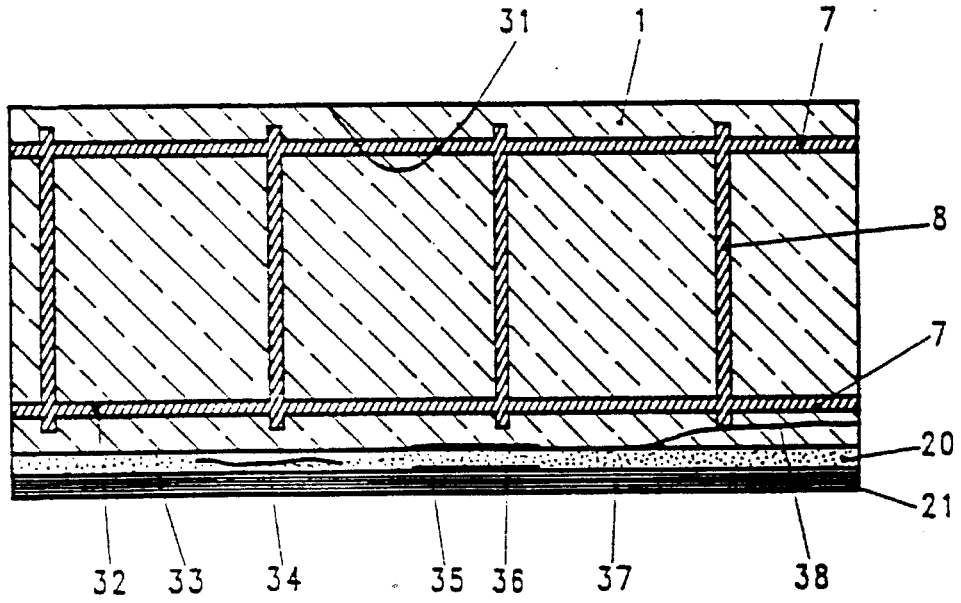

Now it has been found that in the event of exceedingly high shears, various kinds of breaks can arise even in a structure strengthened with such an additional lamination. Various possible kinds of breaks are schematically shown in the cutaway of the bearing beam 1 of FIG. 2 in FIG. 2*b*. The break type referenced by 31 is concrete upset in the compression zone, reference 32 is a steel break in the tensive zone, 33 is a lamination break, 34 is a cohesion rupture at the concrete surface, 35 is an adhesion rupture at the lamination surface, 36 is an adhesion rupture at the concrete surface, 37 is an inter-laminar break of the lamination and reference 38 denotes a concrete shear-rupture in the tensive zone which, as a rule, leads to shearing the lamination 21 off the beam 1.

In order to oppose in particular the concrete shear-rupture in the tensive zone, but also the other kinds of breaks, foremost at the interface between the lamination and the concrete beam 1, the invention presents a shear strengthening means as shown in FIG. 3 in the form of the pre-stressing means 11 described in relation to FIG. 1. FIG. 3 again shows the bearing beam of FIG. 2 in cross-section, however it is now fitted with a pre-stressing means 11 also again anchored in sites 13 of the concrete beam 1. The pre-stressing means 11, illustratively, is an aramide-fiber tube and passes on both sides through boreholes 6 in the upper slab of the bearing beam 1 and then through both sides along the base body of the bearing beam and then encloses in its pre-stressed state the strengthening lamination 21 at the lower end of the beam. Again a substrate 16 is provided to make possible improved stressing-distribution by the aramide tube 11 against the lamination 21 and furthermore to preclude damage to the tube 21 in the region where it loops the base body of the bearing beam 1 and the lamination 21. Ideally the substrate 16 would be semi-circular to achieve optimal compression distribution. However, adequate distribution is already achieved by the substrate 16 shown in FIG. 3 which assuredly shall be more advantageous in practice.

As already described, the substrate 16 must be such that the stress in the aramide tube 11 shall be kept up rather than being lessened by forcing the tube 11 into the substrate 16 and/or by compressing the substrate 16.

FIG. 3*a* shows the beam-end zone 2, similarly to FIG. 2, in the area of the support 5. FIG. 3*a* makes it clear that the pre-stressing means 11 are advantageously mounted in the end zone of the lamination 21 because that is where the danger of shearing off the beam 1 is largest. Such shearing off results not on account of inadequate adhesion of the bonding layer 20, but especially by the concrete compressive breaks in the structure shown in FIG. 2*b*.

As shown by FIG. 3*a*, it has been found advantageous to mount at least two pre-stressing means 11, such as aramide tubes, in the end zone of the lamination 21. Where possible, the additional pre-stressing means 11 of the invention are mounted essentially mid-way in the area of two transverse shear reinforcements 8 of the structure 1. The primary importance, however, is to optimally press the end of the pre-stressed lamination 21 against the structure 1.

If on the other hand further pre-stressing means 11 of the invention are provided over the entire length of the lamination 21, namely to prevent this lamination from detaching anywhere from the beam, then advantageously the illustrative aramide tubes are mounted essentially mid way between two shear reinforcements 8.

For shearing forces arising especially in the two end zones 2 and 3 of the loaded bearing beam 1, the shear strengthening means of the invention advantageously will be mounted especially in these two end zones. In principle, the shear strengthening means of the invention assume a function similar to the shear reinforcements inside the structure which, as shown by FIG. 2, also are preferably located in the two end zones 2 and 3 of the bearing beam 1.

As already mentioned, the strengthening lamination 21 can be advantageously pre-stressed. This is especially appropriate when using fiber compound laminations on the basis noted above.

Figure 4:
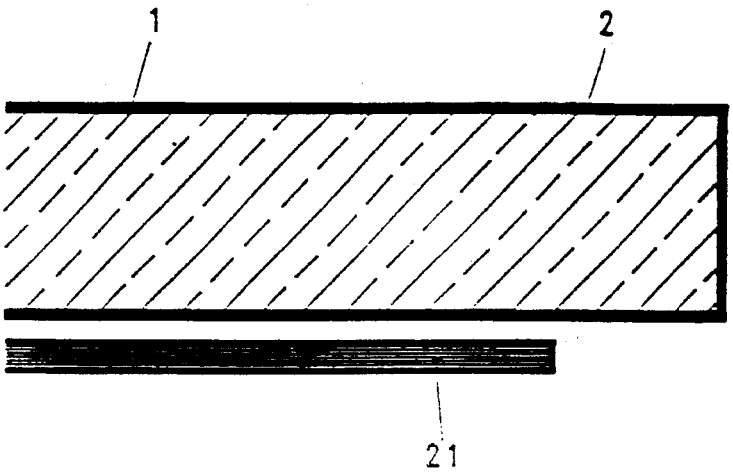
Figure 4A:
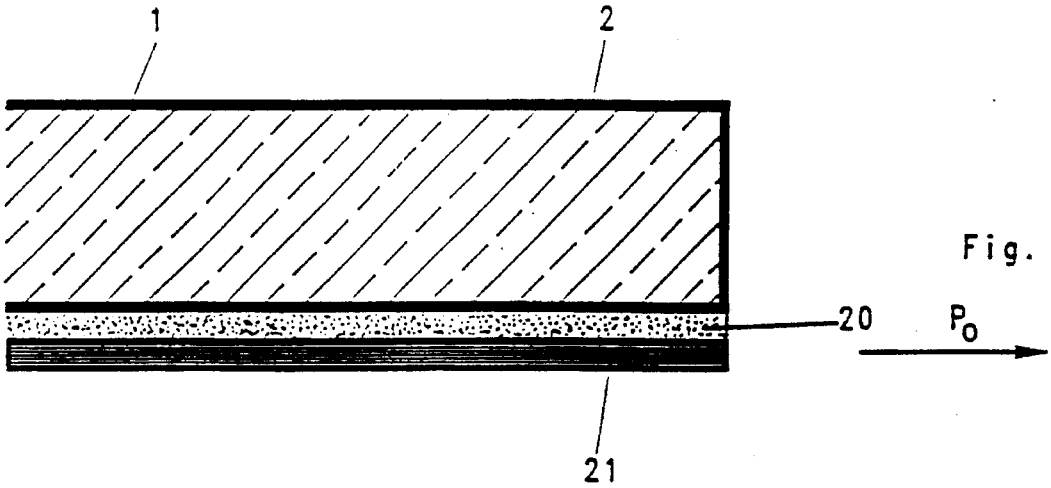
Figure 4B:
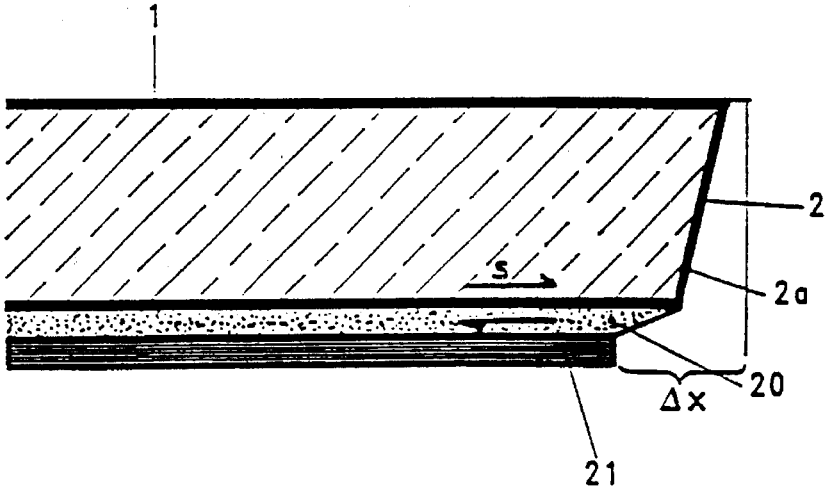

The technique of pre-stressing such laminations is schematically shown in FIGS. 4, 4*a* and 4*b*.

FIG. 4 is a longitudinal section of a bearing beam 1 near the end zone 2 which is to receive a pre-stressed fiber compound lamination 21.

As shown by FIG. 4*a*, the lamination 21 is stressed in the direction of the tip of the end zone 2 of the beam 1 by applying a force $P_0$. While being pre-stressed, it is firmly connected by depositing an adhesive layer 20, for example an epoxy resin, on the bearing beam 1. The lamination 21 can be pre-stressed with an entirely arbitrary tensioning or stressing apparatus. Such a procedure for pre-stressing is generally known and, in particular, is described in the ETH dissertation No. 8918 and therefore it is omitted herein.

Now FIG. 4*b* shows what happens, indicated by $\Delta x$, in the end zone of the beam 1 in the absence of the tensive force $P_0$. The stress in the lamination 21 generates the shearing stress S in the structure, as a result of which there is danger of shear cracks arising in the area 2*a* of the beam 1. If the cracks were to grow to a certain size, the lamination consequently would shear off in impulsive manner and as a rule detachment would propagate toward the beam center. Thereby the desired strengthening of the beam would be lost.

Figure 4C:
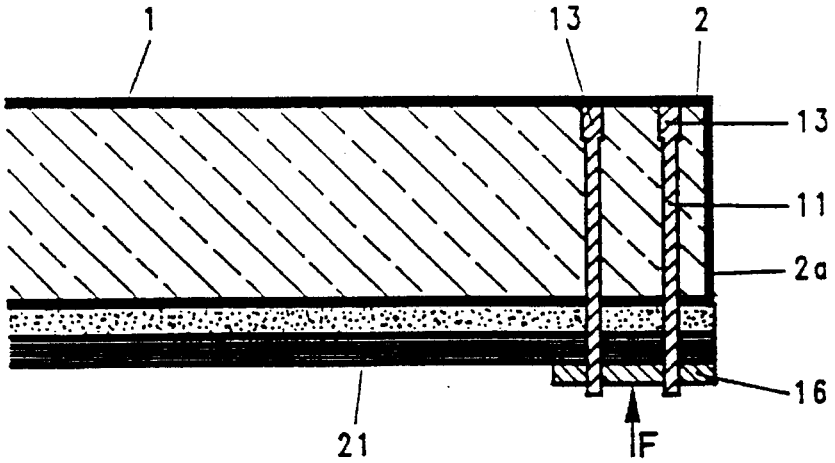

FIG. 4*c* shows the shear strengthening means of the invention mounted in the end zone of the lamination 21, a force F acting on the lamination 21 in the direction of the beam 1. Thereby the formation of cracks shall be minimized by a multi-axial stress in the concrete. When cracks occur, serrating them effectively allows further successful anchoring of the lamination into the structure. In the manner of FIG. 3*a*, two aramide tubes 11 are mounted in FIG. 4*c* and are pre-stressed over a substrate 16 against the end zone of the lamination 21. The lamination 21 is anchored by pre-stressing means 11 in the same manner at the opposite but omitted end of the beam 1 into it.

Figure 5:
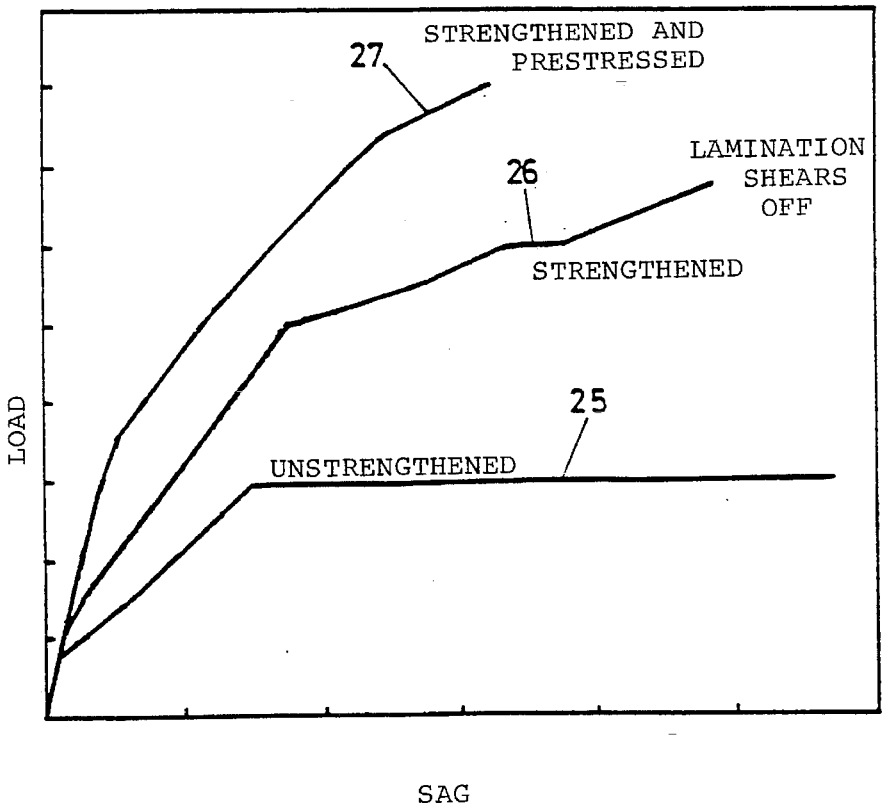
FIG. 5 is a graph of beam sagging under load, for the unstrengthened, lamination-strengthened and pre-stressed-lamination strengthened states.

The graph of FIG. 5 shows the advantageous effect of pre-stressing the lamination 21 on the loading capacity of a bearing beam. A reinforced-concrete beam similar to the one shown in FIG. 2 is propped up and increasingly loaded and the corresponding sagging observed. Line 25 of the graph of FIG. 5 shows the reinforced-concrete beam without an external lamination strengthening, line 26 shows the same beam now provided with a carbon-fiber lamination, and line 27 shows again the same beam fitted with the same carbon-fiber lamination pre-stressed for instance between 0 and 90% of its tensile strength and being anchored at each end zone with pre-stressing means of the invention into the bearing beam. Line 27 shows the largest load-bearing capacity for the bearing beam by the pre-stressed carbon-fiber lamination.

When pre-stressing in the above manner by a magnitude exceeding about 5% the tensile strength of the lamination, use of the pre-stressing means of the invention, such as the aramide-fiber tubes, will be mandatory because otherwise the laminations shall be immediately sheared off the end zones. Tests have shown that carbon-fiber laminations can be mounted on a bearing beam only for a stress up to $50N/mm^2$ before the pre-stressing means of the invention become necessary. Higher pre-stressing forces at once caused lamination detachment.

In order to reliably anchor a lamination of FIG. 4*c* into a bearing beam when the pre-stressing forces are approximately the above mentioned magnitudes, the aramide tubes are endowed with a tensile strength per tube of 25 kN.

In order to maintain such high tensile strengths in the pre-stressing means, for instance aramide tubes, it is obviously mandatory that they be reliably and solidly anchored into the concrete support at the zones opposite the strengthening lamination.

A method for effectively anchoring such tubes is discussed further below in relation to FIG. 7.

First, it will be shown in relation to FIGS. 6 and 6*a* how the shear-strengthening means of the invention can be anchored in similar manner into a concrete slab. FIG. 6, similar to FIG. 1, is a lengthwise perspective of a concrete slab 1. The pre-stressing means of the invention is mounted in the manner of the invention in the cross-section 4 and is solidly anchored into sites 13 of the concrete slab or paving. Furthermore, the concrete paving or floor slab 1 comprises at its underside an elongated carbon-fiber strengthening lamination 21 which is similar to those discussed above.

FIG. 6*a* shows the cross-section along line II—II of FIG. 6 and corresponds substantially to FIG. 1*a*. The pre-stressing means, i.e., the shear strengthening means 11, runs from the anchoring sites 13 through boreholes 6 in the concrete slab to the opposite side of the cross-section and encloses a compression plate 16 pressing against the lamination 21. The lamination 21 in turn rests against the segment 15 at the periphery of the cross-section 4. Because of the pre-stressing of the means 11 which, illustratively, is a fabric-like belt or band, the compression plate 16 is forced against the lamination 21 and thereby the lamination 21 is prevented from shearing off the concrete paving or slab 1 in the vicinity of the segment 15 of the cross-section 4. Obviously, the concrete paving or slab 1 can be additionally fitted with steel reinforcements as shown for example in FIG. 2 and following.

The concrete structures shown in FIGS. 1 through 6 are merely illustrations serving to elucidate the invention. Obviously such structures also can be bridges, pavings, floor slabs, reinforced-concrete beams or any other two-dimensional or elongated construction structure, including those covering several surfaces and made of very diverse materials such as wood, metal, concrete etc. which must serve as supports. Again the manner of pre-stressing of the invention in or at a cross-section of such a concrete structure can be implemented in entirely arbitrary manner. Pre-stressing can be applied to the structure not yet loaded or only slightly loaded, or the pre-stressing means can be applied while being very slack or only slightly tensioned so that increased pre-stressing only takes place at increased loading, i.e., shearing of the structure. Obviously too the shear-strengthening methods and means of the invention can be used in a new building or in restoring an extant one. The choice of the pre-stressing means as well is manifold, and in lieu of the above-described, specifically designed fabric materials, so-called unidirectionally stretched rovings or carbon-fiber laminations can be used which are similar to those shown in the Figures and denoted as 21. However, steel bands, cables, belts and the like made of other materials evincing high strength are applicable in the invention.

Accordingly, the concept of the invention can be modified in many ways, it being essential that by selecting the pre-stressing means in or at a cross-section in the concrete structure to be strengthened there shall be achieved at least segment-wise pre-stressing to effectively counteract the shear forces arising upon loading.

Lastly, FIG. 7 shows by a schematic cross-section how, for instance an aramide-fabric tube, can be pre-stressed and anchored in the structure. The aramide tube 11 is pulled by tensive, stressing or compressive means (not shown) in the direction of the arrow 50, at first through the borehole 6 in the structure 1. A conical widening 41 is present in the structure 1 at the site 13 and in this conical widening the tube 11 is expanded in the zone 42 by placing an adhesive 43 inside the zone 42. On account of gravity, the highly viscous adhesive 43 flows in the direction of the arrow toward the borehole 6. The adhesive, for example can be an epoxy resin or a thermoplastic polymer melt.

Thereupon, the aramide tube is pulled through a circular bush 44 mounted on the structure 1 and the inside of the bush again is conical flaring in the longitudinal direction. By mounting a wedge or cone 45 inside the tube, the tube once more is widened inside the bush. The cone 45 preferably is roughened at its surface and comprises furthermore transverse annular recesses 46 to allow a follow-up slippage of the wedge when the tube 11 is pulled in the direction of the arrow 50 and to achieve an immediate wedging effect once the force 50 drops. To prevent the bush 44 from moving back toward the structure, it can be affixed, for example, by a thread 47 to a casing 48.

Finally, the tube 11 is pulled by its segment 49 through a tensive, stressing or compressive means (not shown) in the direction of the arrow 50 until adequate tension has been achieved. This tension is maintained until the adhesive 43 has completely and adequately cured. Depending on the choice of adhesive, this can amount to a few minutes or several hours.

The advantage offered by the pre-stressing means shown in FIG. 7, i.e., the anchoring of the pre-stressing means into the structure 1, is the elimination of additional mechanical anchors. Moreover, accurate pre-stressing can be provided and this pre-stressing level shall be substantially preserved following the anchoring of the pre-stressing means 11. Lastly, the pre-stressing means 11 can be finished to be flush with the surface of the structure 1 so as to eliminate any projections.

The diagrammatically shown pre-stressing method of FIG. 7 is suitable for any tubular pre-stressing means such as the above noted aramide tubes. Obviously there is no compulsion that the tube be fabric-like and the materials employed can be selected in a wholly arbitrary manner. Obviously the advantage of material selection is that the widening in the zone 42 holding the adhesive inside the tube is substantially simpler and better than if, for example, a substantially "solid" tube were used.

There is ample selection from the available materials, illustratively these being steel-, glass-, carbon-fibers or others. The essential point is that a tube of high tensile strength can be formed.

We claim:

1. A method for increasing the shear strength of an elongated bearing member having a length and a width comprising mounting at least one pre-stressing means in relation to at least one cross-sectional area of said elongated bearing member so that said at least one pre-stressing means is positioned essentially transverse to the length of said elongated bearing member in a pre-stressed manner, and further in said mounting of said at least one pre-stressing means, positioning said pre-stressing means in a pre-stressed manner having ends embedded at least in part in the elongated bearing member and having an intermediate portion positioned at least in part along a peripheral surface of the at least one cross-sectional area of said elongated bearing member.

2. A method according to claim 1 wherein said mounting of said at least one pre-stressing means comprises mounting two pre-stressing means in relation to two separate cross-sectional areas of said elongated bearing member, one pre-stressing means in each of said cross-sectional areas.

3. A method according to claim 1 wherein said elongated bearing member includes at least one longitudinal lamellar reinforcement externally mounted thereon, and further comprising in said mounting of said at least one pre-stressing means, compressing of said at least one longitudinal lamellar reinforcement by said at least one pre-stressing means.

4. A method according to claim 1 wherein said at least one pre-stressing means is of a form selected from the group consisting of a lamination, tube, hose, belt, band and cable, and made of a tear-resistant material selected from a group consisting of steel fibers, carbon fibers, glass fibers, aromatic polyamide fibers, fiber-reinforced plastics, and fiber compound laminations.

5. A method according to claim 1 wherein said elongated bearing member includes a plurality of inner shear reinforcement elements positioned transversely therein, and wherein in said mounting of said at least one pre-stressing means, said at least one pre-stressing means is mounted substantially midway between two of said plurality of inner shear reinforcement elements.

6. A method according to claim 1 wherein said elongated bearing member is a member of a bridge, bearing beam, T-beam, floor slab or paving slab.

7. A method for increasing the shear strength of an elongated bearing member having a length and a width comprising mounting at least one pre-stressing means in relation to at least one cross-sectional area of said elongated bearing member so that said at least one pre-stressing means is positioned essentially transverse to the length of said elongated bearing member in a pre-stressed manner, and further in said mounting of said at least one pre-stressing means, positioning said pre-stressing means in a pre-stressed manner at least in part along a peripheral surface of the at least one cross-sectional area of said elongated bearing member, and further comprising affixing externally at least one pre-stressed elongated fiber lamination to said elongated bearing member such that said at least one lamination is compressed at each end thereof against said elongated bearing member by said at least one pre-stressing means.

8. A method according to claim 7 further comprising mounting said at least one pre-stressing means to externally enclose a portion of said at least one pre-stressed elongated fiber lamination so as to pre-stress said lamination at intervals and in turn compress said elongated bearing member.

9. An elongated bearing member having a length and a width, said elongated bearing member having increased shear strength and comprising at least one pre-stressing means having a form selected from a group consisting of a lamination, belt, hose, tube, band and cable, wherein said at least one pre-stressing means is present in a pre-stressed manner in at least one cross-sectional area of said elongated bearing member, extends substantially transverse to the length of said elongated bearing member, and has ends embedded at least in part in the elongated bearing member and has an intermediate portion which rests against at least a portion of a peripheral surface of said at least one cross-sectional area.

10. Elongated bearing member according to claim 9 wherein said at least one pre-stressing means is made of a material selected from a group consisting of steel fibers, glass fibers, carbon fibers and aromatic polyamide fibers.

11. Elongated bearing member according to claim 9 wherein said elongated bearing member is a member of a bridge structure.

12. Elongated bearing member according to claim 9 further comprising at least one lamellar reinforcement externally mounted on said elongated bearing member with said at least one pre-stressing means mounted on said elongated bearing member so as to compress said at least one lamellar reinforcement transversely against said elongated bearing member.

* * * * *